US005727788A

United States Patent [19]

Davis

[11] Patent Number: 5,727,788

[45] Date of Patent: Mar. 17, 1998

[54] DECK OF PLAYING CARDS

[76] Inventor: Frank R. Davis, 129 Seminole Ave., Norwood, Pa. 19074

[21] Appl. No.: 761,636

[22] Filed: Dec. 6, 1996

[51] Int. Cl.[6] ..... A63F 1/00

[52] U.S. Cl. ..... 273/303; 273/299; 273/308; D21/46; 434/172; 434/167

[58] Field of Search ..... 273/299, 303, 273/307, 308, 272; 434/172, 167, 171; D21/44–46, 42

[56] References Cited

U.S. PATENT DOCUMENTS

| | | | |
|---|---|---|---|
| D. 56,985 | 1/1921 | Moore | D21/46 |
| 1,012,574 | 12/1911 | Adams | 273/299 |
| 4,234,189 | 11/1980 | Chunn | 273/299 |
| 4,333,656 | 6/1982 | Sommer | 273/299 |
| 4,369,976 | 1/1983 | Chunn | 273/303 |
| 4,775,157 | 10/1988 | Armstrong | 273/299 |
| 4,826,175 | 5/1989 | Quatrino | 273/299 |
| 5,067,725 | 11/1991 | Leach | 273/302 |
| 5,524,899 | 6/1996 | Haqedorn | 273/299 |

*Primary Examiner*—Benjamin H. Layno
*Attorney, Agent, or Firm*—Stephen G. Stanton; John S. Munday

[57] ABSTRACT

A deck of cards, comprising at least one set of twenty six cards. Each of the set of cards has two different letters of the alphabet displayed thereon to form thirteen subsets of two cards having the same two different letters thereon. Each card in the thirteen card subset has a picture of one object of a selected group of objects displayed thereon. The displayed object has a name in which the first letter is the same as one of the letters displayed on one of the pair in the subset and not the other of the letters on the pair. In a preferred embodiment, the two different letters are consecutive letters of the alphabet so that the totality of the thirteen subsets has all of the letters of the alphabet displayed in pairs of two letters each. In one embodiment, each letter is displayed in upper case in one location and lower case in another location on its respective card. The selected objects may be divided into four different groups of objects, such as animals, mechanical objects, foods and amusement devices. In one embodiment, the deck comprises two sets of twenty six cards to form a large set of 52 cards, the 52 cards being colored with 13 different colors to produce 13 color sets of 4 cards each. In an alphabet having n number of letters, the deck of cards comprises at least a set of n/2 cards each having two different letters of the chosen alphabet displayed thereon to form n/2 subsets of two cards having the same two different letters thereon. If the number n of letters in the chosen alphabet is an odd number, one of the cards has but one letter thereon.

17 Claims, 1 Drawing Sheet

DECK OF PLAYING CARDS

FIELD OF THE INVENTION

The present invention relates to a deck of cards. More particularly, the present invention relates to a deck of cards for use by children and others in which each card has two different letters of the alphabet and one object depicted thereon which name's first letter is one of those two letters.

BACKGROUND OF THE INVENTION

The use of playing cards for amusement and education has long been appreciated as being a convenient and inexpensive endeavor. In most cases, the cards conform to a standard deck in which four "suits" of cards, such as spades, hearts, diamonds and clubs, each include cards bearing numbers two through ten, and cards representing a "Jack", "Queen", "King" and "Ace". Other permutations of numbers and letters are also found in the prior art. In addition, sometimes cards are used strictly for instructional purposes, such as when cards contain vocabulary or other writings that the user may wish to learn or memorize.

For example, U.S. Pat. No. 5,417,432 to Dwyer describes a deck of 56 standard size playing cards having 26 pairs of cards representing one letter of the alphabet and four wild cards or written instruction cards. Each pair is in a different color. The cards are used with preschool children and may also have a picture corresponding to an object, animal or thing spelled at the bottom of the card and having its first letter corresponding to the lettered card. The cards are arranged and combined in matching letter recognition games, an alphabetic letter sequence racing game, and simple word-forming games. They are designed to avoid the use of any additional numerical indicia to avoid confusing young preschoolers. A large letter is placed in the center of the cards and smaller letters are placed in the upper left corner and inverted in the lower right corner to always display at least one properly oriented letter. However, the object is spelled at the bottom of the card which may confuse younger children or eliminate the effort required for the child to identify the object by a name beginning with the letter depicted on the card. Further, the child's choices of such a name is known to begin with the only letter depicted on the card.

U.S. Pat. No. 5,524,899 to Haqedorn describes an alphabet learning card game in several forms. The preferred embodiment has alphabetic indicia, comprising the upper case and lower case letter, in the upper left corner and like indicia inverted in the lower right corner. The graphic representation of an object having its first letter corresponding to the alphabetic indicia on the card is shown as a mirror image above and below the center of the card so as to present a right side up image and indicia no matter which end of the card is up. Each alphabet-set or suit of cards is preferably identified via a colored-frame around the central object illustrations, such that there are preferably two suits. Specific rules for various games are noted in the patent. As with Dwyer, only one letter is depicted on a single card with one object whose name begins with that single letter. Further, Haqedorn depicts a capital letter and its lower case immediately below it. This proximity of upper case and lower case depiction of the same letter can confuse younger children first learning the alphabet.

U.S. Pat. No. 1,215,657 to Hicks describes a deck of playing cards with which either special games or ordinary games may be played. A certain number of arbitrary symbols or indicia are chosen and arranged in a predetermined order on a number of cards to produce a number of suits and in total making a pack of cards. There are as many like symbols as there are suits with one symbol of each suit and all like symbols are at the same position on each card in which it appears. For example, a deck having 11 symbols would provide 11 suits of five cards each with an optional joker card that may or may not be used. A special game for which the cards are used is described in the patent. Hicks' cards depict several symbols on each card which can tend to confuse children.

U.S. Pat. No. 4,428,582 to Smith describes a set of cards or tiles with numbers on one side and letters on the other side that may be used to play a variety of educational games. There are five cards for each letter of the alphabet with each card having a 1, 2, 3, 4, or 5 on its opposite side for a total of 130 cards in the deck. It is possible to have more or less than five sets for each letter. The letters and numbers, respectively, appear on the center, upper left corner and lower right corner of their side of the card. Various word and number games are explained in detail in the patent. However Smith's obverse side letter depiction and its reverse side number depiction which can confuse younger children. Further, Smith's cards lack an object corresponding to the depicted letter, limiting their use for younger children learning the alphabet.

U.S. Pat. No. 4,588,193 to Winston describes a deck of playing cards preferably comprising 60 two-value cards. The deck consists of 3 different suits with 4 different number values per suit, and 12 half-wild cards consisting of a fifth number value which is wild in terms of its suit. Every number value of a given suit is paired once with every number value of the other suits. The deck is mathematically designed to overcome the statistical inadequacies of two-valued cards of the prior art. A die may also be used that represents the different suits for games in which one suit ranks differently than another suit. Various games using the cards are described in the patent. However, Winston depicts two symbols on each card which each correspond to between two and eight different suit and value possibilities, respectively, which overly complicates their use with younger children and are not suited for use with letters of the alphabet to teach the alphabet.

None of the prior art patents disclose the depiction of two different letters of the alphabet on each card in combination with one depicted object whose name begins with one of those two letters. Nor does any of the prior art depict upper case letters and lower case letters separately at opposite corners of the cards to avoid confusion between the upper and lower case depictions.

Accordingly, it is an object of the present invention to provide a new and improved deck of playing cards.

Another object of this invention is to provide a deck of playing cards in which each card has depicted thereon two different letters of the alphabet and an object with its name beginning with only one of the letters on the card and which is simple for children to play.

Yet another object of the present invention is to provide a deck of playing cards having upper case letters at one corner of each card with a lower case depiction at the opposite corner of each card to minimize confusion of younger children learning the alphabet yet still allowing them to grasp an understanding of upper case and lower case letters.

Other objects will appear hereinafter.

SUMMARY OF THE INVENTION

It has now been discovered that the above and other objects of the present invention may be accomplished in the following manner. Specifically, the present invention provides a deck of cards of at least twenty six cards with each card having two different letters of the alphabet displayed thereon to form thirteen subsets of two cards having the same two different letters so that all the letters of the alphabet are represented. Each card has a picture or design of one object from a selected group of objects displayed on the card such that the object's name has its first letter corresponding to only one of the two different letters on that card. The other card in the two card pair has a picture or design of one object from a selected group of objects displayed on the card such that the object's name has its first letter corresponding to the other letter on that card pair.

The two letters on each card pair may be consecutive letters, i.e. AB, CD, EF, . . . WX, YZ. The two letters on each card may be displayed in upper case in one corner, i.e. upper left, and inverted in lower case in the opposite corner, i.e. lower right, with the picture of the object right side up to the upper case letters. There may be four groups of objects that may consist of animals, mechanical objects, foods and amusement devices. The deck of cards may be printed in thirteen different colors on their obverse side depicting the letters and objects to form thirteen color sets of two cards each. The deck of cards may consist of two sets of twenty six cards wherein the deck includes twenty six pairs of each different picture, and further may be printed in thirteen different colors on their obverse side depicting the letters and pictures to form thirteen color sets of four cards each. It is also possible to construct a deck of cards with n number of cards for use with an alphabet having n number of letters in a similar fashion.

Several games may be played using the deck of cards of the present invention such as matching type games wherein cards having the same pictures are matched in sets, cards having the same letters are matched in sets, or cards having the same colors on their obverse sides are matched in sets. Other games include alternatively drawing cards from a common pile and assembling a winning hand having all the letters in the alphabet, or all the letters in the alphabet in sequence. Another learning game for younger children consists of having the child determine one of the letters on the card by correctly identifying the name of the object pictures on the card drawn, or for a pair of cards having like letters but dissimilar objects depicted correctly identifying the name of the depicted objects and then determining which of the letters correspond to each of the two depicted objects. Other games are also possible.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1A:
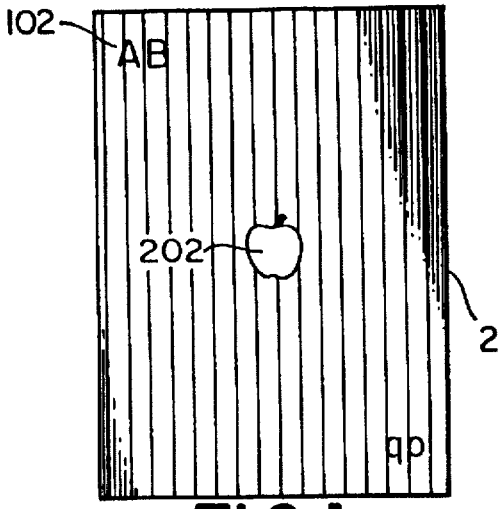
FIG. 1 is a schematic view of the preferred embodiment of the playing faces of three pairs of consecutive letter playing cards, all in accordance with the invention.

As shown in the drawing, a deck of cards made in accordance with the present invention include on each card's 2, 4, 6, 8, . . . 50, 52 obverse side two pair of the same consecutive letters of the alphabet (102, 103), (104, 105), (106, 107), (108, 109), . . . (150, 151), and (152, 153) grouped AB, CD, EF, GH, . . . WX, and YZ with a picture of an object 202, 204, 206, 208, . . . 250, and 252 centered on the card having a common name beginning with one of the letters on the card. The cards may be made of coated card stock or similar materials or appropriate materials to facilitate learning and/or game play. The consecutive letters are in upper case ("AB") 102, 104, 106, 108, . . . 150, and 152 in the upper left hand corner and are inverted in lower case ("ab") 103, 105, 107, 109, . . . 151, and 153 in the lower right hand corner such that when the objects are right-side up, the upper case letters are in the upper left hand corner with the lower case letter inverted in the lower right hand corner. When the objects are inverted, the lower case letters are in the upper left hand corner and the upper case letters are inverted in the lower right hand corner. This allows children, and younger children especially, to easily determine which depiction of the letters are in upper case and which depiction of the letters are in lower case by observing the orientation of the picture of the objects depicted on the cards. The objects depicted may be chosen to be ordinary objects with which the children or players are familiar.

The obverse side of the cards are devoid of any other symbol, depiction or word, such as the name of the depicted object. This prevents children from being confused or overloaded with too much information or choices on each card and allows them to be able to better focus and concentrate on the task at hand. The reverse side of the cards consist of an identical pattern/color so as to not allow identification of the obverse side when viewed from the reverse side. In one embodiment, the obverse sides of the cards may be printed in one of thirteen different colors to form thirteen color sets of two cards each in a twenty-six card deck.

It is also possible to chose objects with which it is desired to have the children become familiar, for example science or geography learning oriented decks or religious learning oriented decks which depict objects to be learned having names beginning with one of the letters of the alphabet on the card. Such decks would be used with children, or others, who already know the alphabet. It would also be possible to teach other alphabets, such as Hebrew or Russian, by depicting commonly known objects having names beginning with one of the letters depicted on the cards. The number of cards, n, used would be modified to accommodate the number of letters, n, in the chosen alphabet.

Any two different letters may be chosen for each card, although in the preferred embodiment, consecutive letters beginning AB then CD, etc. and ending WX and YZ are used such that cards would comprise the entire alphabet, and two such sets of thirteen cards would comprise a deck. It is also possible to combine two such twenty six card decks to form one fifty two card deck. In such a fifty two card deck, the obverse sides of the cards may be printed in one of thirteen different colors to form thirteen color sets of four cards each. The use of two letters on each card increases the thought processes necessary to determine which of the two letters is related to the depicted object, which in turn increases the retention of the information to be learned.

Figure 1B:
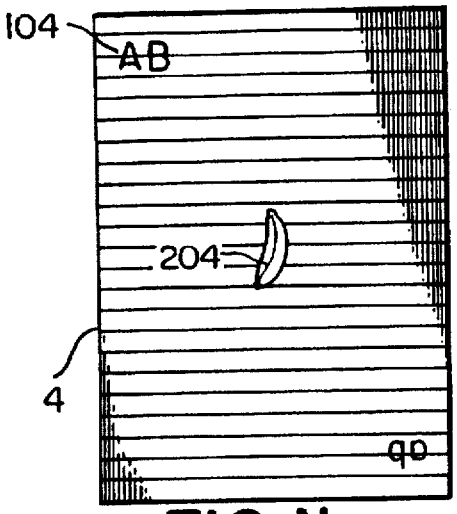
Figure 1C:
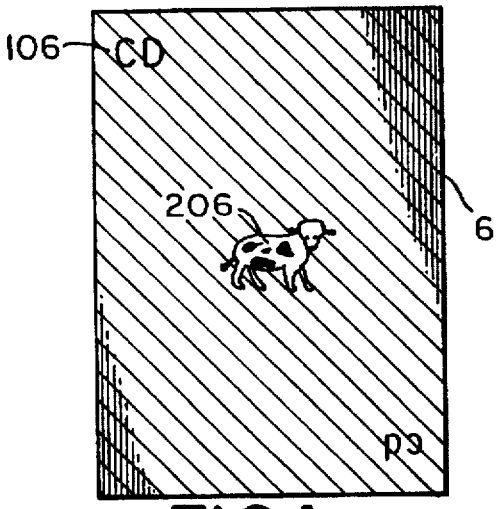
Figure 1D:
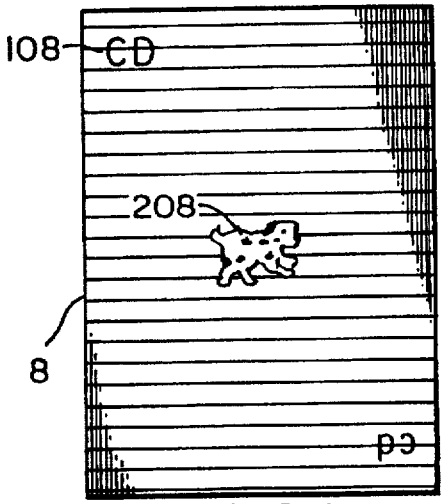
Figure 1E:
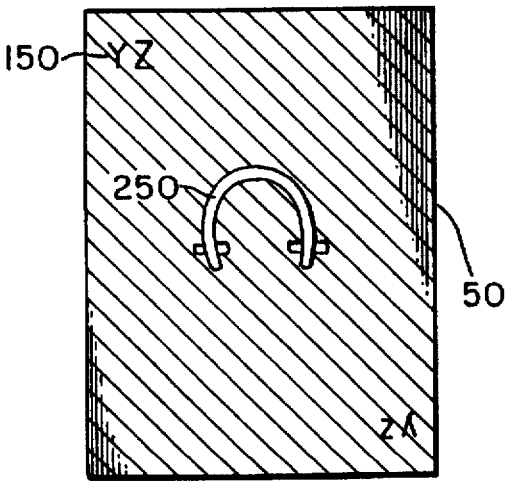
Figure 1F:
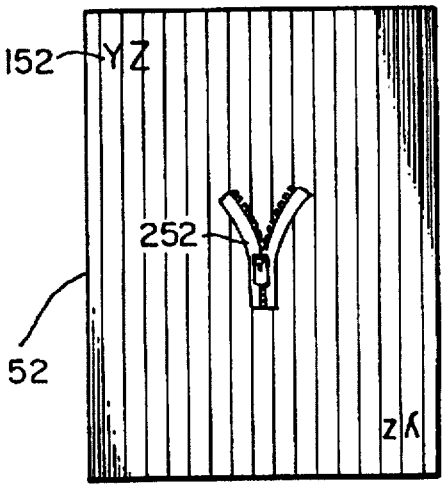

The card deck would consist of cards similar to those depicted in FIG. 1 but are not limited to the style or letter or type style shown, nor limited in pictorial design as shown but be open to any design, photograph, licensed character or other artwork or lack of design as is necessary to facilitate use of the cards. The depicted objects selected are not limited and different decks of cards made in accordance with the present invention could have completely different objects depicted thereon. The alphabet chosen is not limited to the English alphabet but may be, for example, Spanish, Hebrew, Russian, or Arabic.

Following are examples of the use of the deck of cards made in accordance with the present invention. These specific examples are not limiting and many additional uses of the deck of cards in education, learning and gaming are possible.

In the first example, for the English alphabet, all the cards in the deck, numbering twenty six, fifty two, or any greater multiples of twenty six are shuffled and placed face down in a draw pile between the players. Each player in turn draws one card per turn and attempts to form a winning hand having all the letters in the alphabet. If a card is chosen that duplicates letters already held, that card is discarded face up in a separate adjoining discard pile. The next player has the option of drawing the top face down card from the draw pile or the top face up card from the discard pile. Play proceeds clockwise until a winning hand is placed face up for confirmation by all other players. If such a player's purported winning hand is in fact deficient in one or more letters or contains any duplicate letters, that player picks his hand back up and all other players chose one card each at random from that player's hand and the offending player must then randomly discard an additional two cards per each other player. Play then resumes until a bona fide winner is declared. In a modification of this game, all the letters in the alphabet must also be arranged in the correct order in each player's hand. Points may then be awarded not only for the winning hand in correct alphabetic order, but also for all players' hands that have their cards placed in the proper alphabetic order. Such games teach the alphabet and the correct sequence of the alphabet.

In the second example, all the cards are shuffled and placed face down in a draw pile between the players. The player then agree as to what will be matched to form sets, for example letters, objects or colors. Each player draws seven cards and places them in his/her hand. One player is chosen to go first and that player then asks any one other player for an indicia (letter, object or color) that would match another card in his/her hand. If the player asked does have a card with the requested indicia, he/she gives that card to the requesting player and the requesting player again asks another player for a matching card. If the other player does not have a card with the requested indicia, the requesting player draws the top card from the draw pile. If that drawn card does have the requested indicia, the player shows the card to the other players, and continues his/her turn. Once a player has a matching set of cards in his/her hand, he/she places those sets face up in from of him/her. The player with the most matching sets once all cards are drawn is the winner. This game may be modified in that each player may chose which single indicia they will match for that hand, i.e. letters, objects, or colors. Once chosen, each player may not change his/her matching indicia for that hand. This decision may be made after the players' hands are selected, requiring each player to determine which of the three indicia, letters, objects or colors, produces the maximum number of matching sets in their initial hand.

Other games may be devised and played with the deck of cards made in accordance with the present invention. The versatility of the deck of cards of the present invention provides that the only limitation on the games selected would be the children's/players' imaginations and ingenuity. The depiction of two different letters with one depicted object whose name begins with one of those letters provides a clue to the identity of the letters on the card for children or players learning the chosen alphabet while requiring additional thought to determine which of those letters begins the object's name. This extra effort increases retention of the learned information. The same rational follows if the cards are used with known letters, but with objects chosen to be learned as in a science, biology, or geography learning deck.

While particular embodiments of the present invention have been illustrated and described, it is not intended to limit the invention, except as defined by the following claims.

I claim:

1. A deck of cards, comprising:

at least one set of twenty six cards;

each said card having two different letters of the alphabet displayed thereon to form thirteen object subsets of two cards having the same pair of letters thereon, each said object subset having a first card and a second card; and each said card having a picture of an object displayed thereon, said object displayed on said first card having a name in which the first letter thereof is the same as one letter displayed thereon, and said other object displayed on said second card having a name in which the first letter thereof is the same as the other letter displayed thereon.

2. The deck of cards of claim 1, wherein said objects displayed on said cards are selected from a group of objects.

3. The deck of cards of claim 2, wherein said selected objects comprise four different groups of objects.

4. The deck of cards of claim 3, wherein said four different groups of objects are animals, mechanical objects, foods and amusement devices.

5. The deck of cards of claim 1, wherein said different letters are consecutive letters of the alphabet so that the totality of said thirteen subsets has all of the letters of the alphabet displayed in pairs of two letters each.

6. The deck of cards of claim 1, wherein each letter is displayed in upper case in one location and lower case in another location on its respective card.

7. The deck of cards of claim 6, wherein said upper case letters are in the upper left hand corner of said cards and said lower case letters are inverted and in the lower right hand corner of said cards.

8. The deck of cards of claim 1, wherein said twenty six cards are colored with 13 different colors on their obverse side including said letters and said pictures, with a common design on their reverse side, to produce 13 color subsets of 2 cards each.

9. The deck of cards of claim 1, wherein said deck comprises two sets of twenty six cards to form a large set of 52 cards, said 52 cards being colored with 13 different colors to produce 13 color subsets of 4 cards each.

10. A deck of cards, comprising:

at least one set of twenty six cards;

each card of said set of cards having two different letters of the alphabet displayed thereon to form thirteen object subsets of two cards having the same two different letters thereon, each said object subset having a first card and a second card, said two different letters being consecutive letters of the alphabet so that the totality of said thirteen object subsets has all of the letters of the alphabet displayed in pairs of two consecutive letters each, each letter being displayed in upper case in one location and lower case in another location on its respective card; and each said card in said set of cards having a picture of an object, selected from a group of objects, displayed thereon, said object displayed on said first card having a name in which the first letter thereof is the same as one consecutive letters displayed thereon, and said other object displayed on said second card having a name in which the first letter thereof is the same as the other consecutive letter displayed thereon.

11. The deck of cards of claim 10, wherein said selected objects comprise four different groups of objects.

12. The deck of cards of claim 11, wherein said four different groups of objects are animals, mechanical objects, foods and amusement devices.

13. The deck of cards of claim 10, wherein said twenty six cards are colored with 13 different colors on their obverse side including said letters and said pictures, with a common design on their reverse side, to produce 13 color subsets of 2 cards each.

14. The deck of cards of claim 10, wherein said deck comprises two sets of twenty six cards to form a large set of 52 cards, said 52 cards being colored with 13 different colors to produce 13 color subsets of 4 cards each.

15. The deck of cards of claim 10, wherein said upper case letters are in the upper left hand corner of said cards and said lower case letters are inverted and in the lower right hand corner of said cards.

16. A deck of cards, comprising:

at least one set of n number of cards for use with an alphabet having n number of letters;

each card in said set of cards having two different letters of the alphabet displayed thereon to form n/2 number of object subsets of two cards having the same two different letters thereon, each said object subset having a first card and a second card; and each said card in said set of cards having a picture of an object, selected from a group of objects, displayed thereon, said object displayed on said first card having a name in which the first letter thereof is the same as one letter displayed thereon, and said other object displayed on said second card having a name in which the first letter thereof is the same as the other letter displayed thereon.

17. The deck of cards of claim 16, wherein if the number of letters n of said alphabet is odd, then n/2 is rounded up to the next whole number and one of said cards has one letter of said alphabet displayed thereon.

* * * * *